United States Patent [19]

Fukushima et al.

[11] 3,999,392

[45] Dec. 28, 1976

[54] METHOD OF CONSTRUCTING A WALL FOR SUPPORTING EARTH

[75] Inventors: Yoshikiyo Fukushima, Tokyo; Shigeru Watanabe, Suita, both of Japan

[73] Assignees: Nikkai Giken Co., Ltd., Osaka; Nippon Concrete Industries Co., Ltd., Tokyo, both of Japan

[22] Filed: Aug. 18, 1975

[21] Appl. No.: 605,351

[52] U.S. Cl. ..... 61/39; 61/53.52; 61/59

[51] Int. Cl.[2] ..... E02D 7/20

[58] Field of Search ..... 61/35, 39, 41 A, 49, 61/53.5, 53.52, 53.64, 58–62

[56] References Cited

UNITED STATES PATENTS

| | | | |
|---|---|---|---|
| 727,989 | 5/1903 | Miller | 61/58 |
| 3,429,126 | 2/1969 | Wey | 61/35 |
| 3,492,826 | 2/1970 | Horstketter et al. | 61/49 |
| 3,499,293 | 3/1970 | Kato | 61/53.64 |

FOREIGN PATENTS OR APPLICATIONS

| | | | |
|---|---|---|---|
| 446,471 | 7/1927 | Germany | 61/58 |

*Primary Examiner*—Paul R. Gilliam
*Assistant Examiner*—David H. Corbin
*Attorney, Agent, or Firm*—Fidelman, Wolffe & Waldron

[57] ABSTRACT

This invention relates to a method of constructing a continuous wall for supporting earth by continuously setting a number of steel sheet piles, in which a hole is bored with a screw auger, a sheet pile is sunk into the said hole with the boring, a joint of the said sheet pile is engaged with a corresponding joint of the following sheet pile, the said following sheet pile is sunk with the boring of a hole for the said following sheet pile with the said screw auger, and these operations are repeated; and further into the said holes concrete is placed or concrete piles are sunk as required.

11 Claims, 12 Drawing Figures

METHOD OF CONSTRUCTING A WALL FOR SUPPORTING EARTH

SUMMARY OF THE INVENTION

This invention relates to a method of constructing a wall for supporting earth with the main object of rapid execution of quay of rivers or a reclaimed land, and side walls of road, subway, underground construction or the like.

So far walls have been constructed by driving steel sheet piles, H-beams or the like with a drop hammer, or by previously boring holes with a screw auger and pouring bentonite or the like into the holes so as to prevent the collapse of each hole wall.

However, the former method is unsuitable in places where there are human habitations because of severe vibration and noise and the execution is difficult in the solid ground. Moreover in the latter method working efficiency is bad and treatment of sludge due to bentonite is required.

Furthermore in the abovementioned methods the surface of a wall is uneven because of unsufficient guide at the time of driving sheet piles and thereby appearance is not good, and it is difficult to completely shut off earth, water or the like between each sheet pile.

The present invention is to dissolve the above problems. The first object of the present invention is to provide a method of constructing a wall for supporting earth in which execution is easy and vibration and noise are very little.

The second object of the present invention is to provide an efficient method of constructing a wall.

The third object of the present invention is to obtain good arrangement of sheet piles constituting a wall and perfect watertight effect.

The other objects and the features of the present invention will be apparent in the later description of some embodiments.

BRIEF DESCRIPTION OF THE DRAWINGS

FIG. 2(A) is a sectional elevation view showing the beginning of the insertion of a sheet pile into a hole board with an auger;

FIG. 2(B) is a sectional elevation view showing the state in which the sinking of the sheet pile is in progress;

FIG. 2(C) is a sectional elevation view showing the state in which the sinking of the sheet pile is finished and the auger is taken out from the hole;

DETAILED DESCRIPTION OF THE INVENTION

Figure 1:
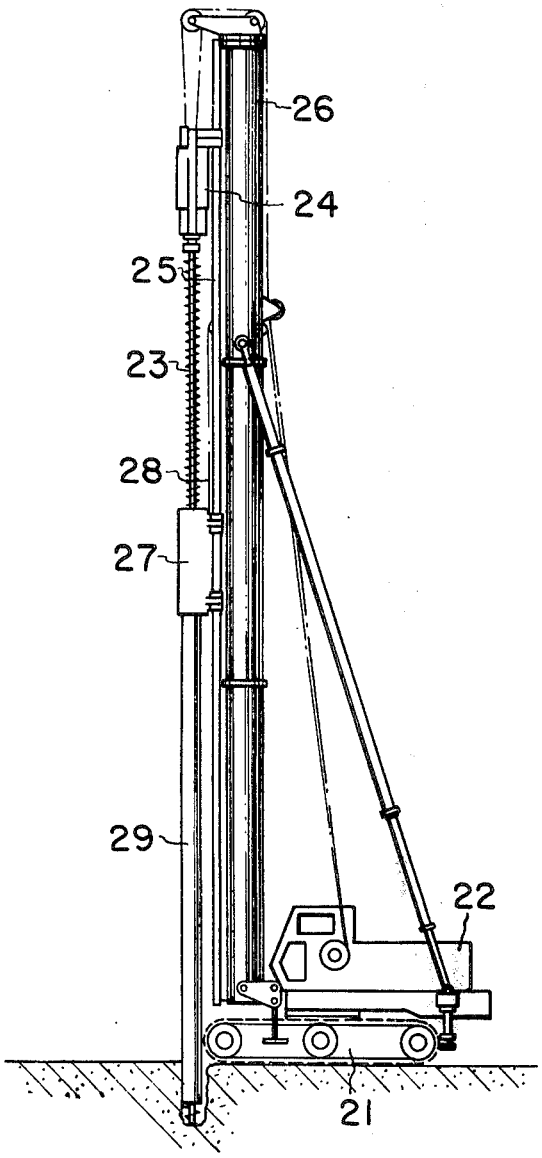
FIG. 1 is a side elevation view showing one example of an apparatus to use in the enforcement of the method of the present invention.

FIG. 1 is a side elevation view showing that a steel sheet pile is being sunk with the boring by a screw auger. Reference numeral 21 designates a base having caterpillar which is freely movable forward and backward, 22 designates an operation unit installed on the said base 21 in the manner it can be freely turned horizontally. The said base 21 and the said operation unit 22 are very heavy and a tower 26 is standing erect in front of them supporting a screw auger 23 and a driving part 24 for rotating the said auger 23.

Reference numeral 25 designates a rail provided vertically along the front surface of the said tower 26. The driving port 24 for rotating the screw auger 23 is provided on the rail 25 in the manner it can freely slide upward and downward. The top of the screw auger 23 standing erect along the tower 26 is directly connected to the driving part 24. Reference numeral 27 designates a weight sliding vertically on the rail 25 at the lower part of the driving part 24. The screw auger 23 is inserted through the inside of the weight 27, and the weight 27 is suspended from the tower 26 with a wire 28. Reference numeral 29 designates a steel sheet pile having a semicircular section. The steel sheet pile 29 is held at the lower front side of the screw auger 23 so as to stand erect along the auger, and the said weight 27 is placed on the top of the sheet pile 29.

Figures 2A, 2B, 2C:
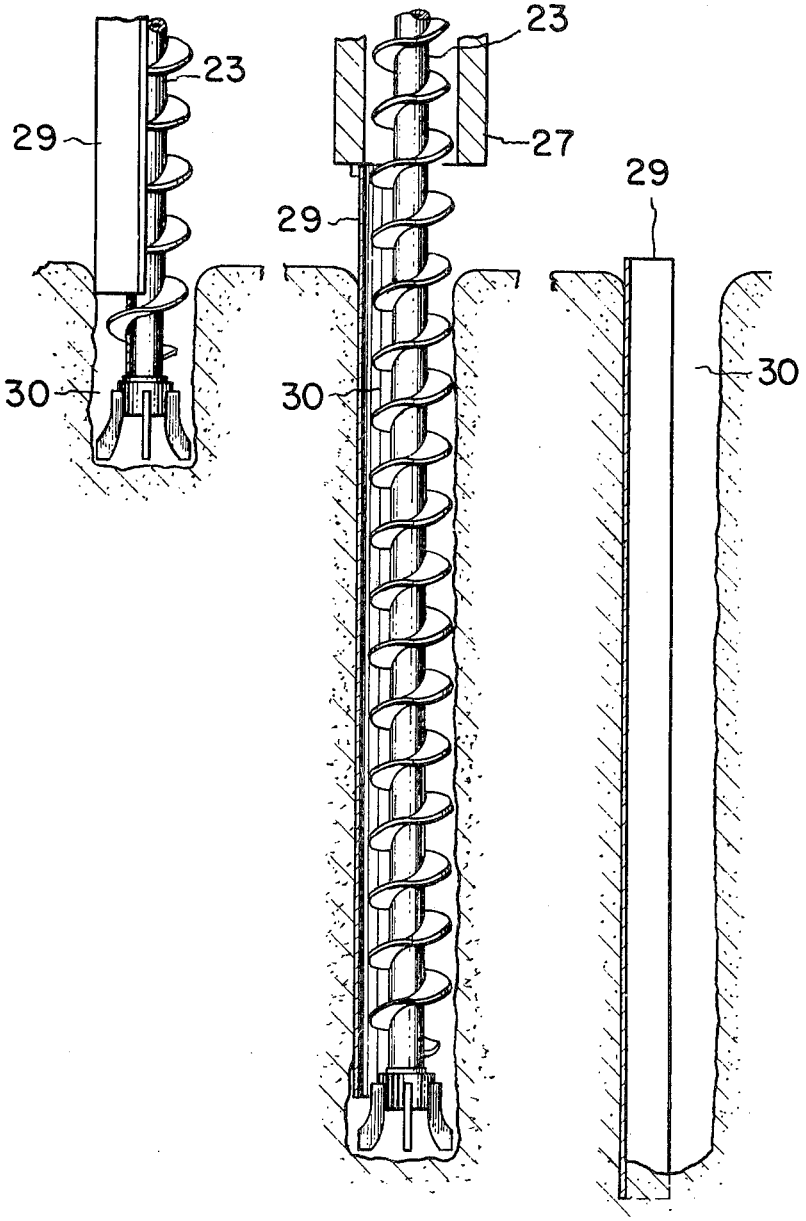
FIGS. 2(A) to 2(C) show the process of constructing a wall according to the present invention.

The sinking condition of the sheet pile by the abovementioned apparatus will be explained referring to FIGS. 2(A) to 2(C). As shown in FIG. 2(A), first the screw auger 23 is driven to bore a hole 30 at a determined position to a certain depth into which the sheet pile 29 is put. Next the sheet pile 29 is moved down along the screw auger 23 and the weight 27 is put on the top of the said sheet pile 29 to give pressure force. Boring is continued with the screw auger 23 and the sheet pile 29 is gradually sunk into the hole 30 by the load of the weight 27.

In FIGS. 1 and 2 the sheet pile 29 is sunk by the dead-weight of the weight 27. It is possible to make the sinking more smooth by putting an oil pressure cylinder or the like between the weight 27 and the sheet pile 29 and slightly extending and shortening it to cause vibration. Otherwise it is also possible that the dead-weight of the driving part 24 is directly given to the top of the sheet pile 29 without providing the weight 27.

When the hole is bored to the required depth, the sinking depth of the sheet pile 29 is finally determined. Thereafter the auger 23 is taken out from the hole 30 as shown in FIG. 2(C). Following sheet pile is sunk next the sheet pile 29, sunk as abovementioned, by the same method so as to make a continuous wall. The following sheet pile is not only put next the prior sheet pile, but also engaged with the prior one as shown in the plan views of FIGS. 8, 9 and 10.

Figure 8:
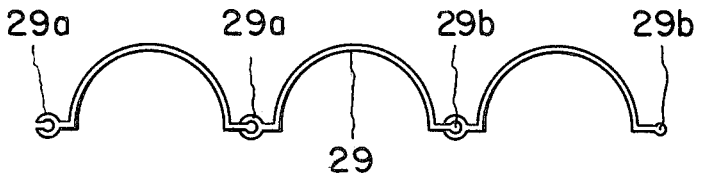
FIGS. 8, 9 and 10 are plan views showing joint structures of sheet piles in each wall.

Namely in FIG. 8 a sheet pile 29 of a semicircular section has joints 29*a* and 29*b* on both sides, one joint 29*a* is formed into a pipe of C-section and another joint 29*b* is formed into a pipe or round bar so as to be put into the hollow part of a corresponding joint of C-section.

Therefore when following sheet pile 29 is sunk next prior sheet pile 29, it is required that the top of the joint 29*a* (or 29*b*) of the prior sheet pile 29 is engaged with the bottom of the corresponding joint 29*b* (or 29*a*) of following sheet pile 29. The sectional shape of the joints 29*a* and 29*b* is not limited to circle, but it may be polygon.

Figure 9:
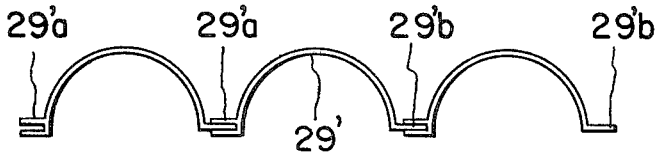
Figure 10:
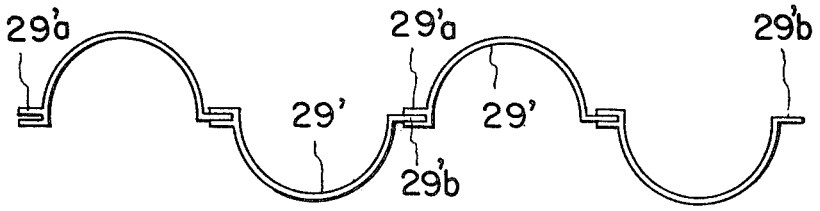

As for a sheet pile 29' shown in FIGS. 9 and 10, one joint 29'*a* is formed into a plate and another joint 29'*b* has a groove into which a plate-shaped joint 29'*a* of the next sheet pile is put in the freely slidable manner. Similarly to the abovementioned sheet pile 29, a joint 29'*a* is engaged with a joint 20'b corresponding to the joint 29'*a* and the sinking of following sheet pile 29' is guided by prior sheet pile 29'. In FIG. 10, when sheet piles 29' are sunk in order, aspect of following sheet pile 29' is made opposite to that of prior one. The aspect of sheet piles can be changed at optional positions.

Figure 3:
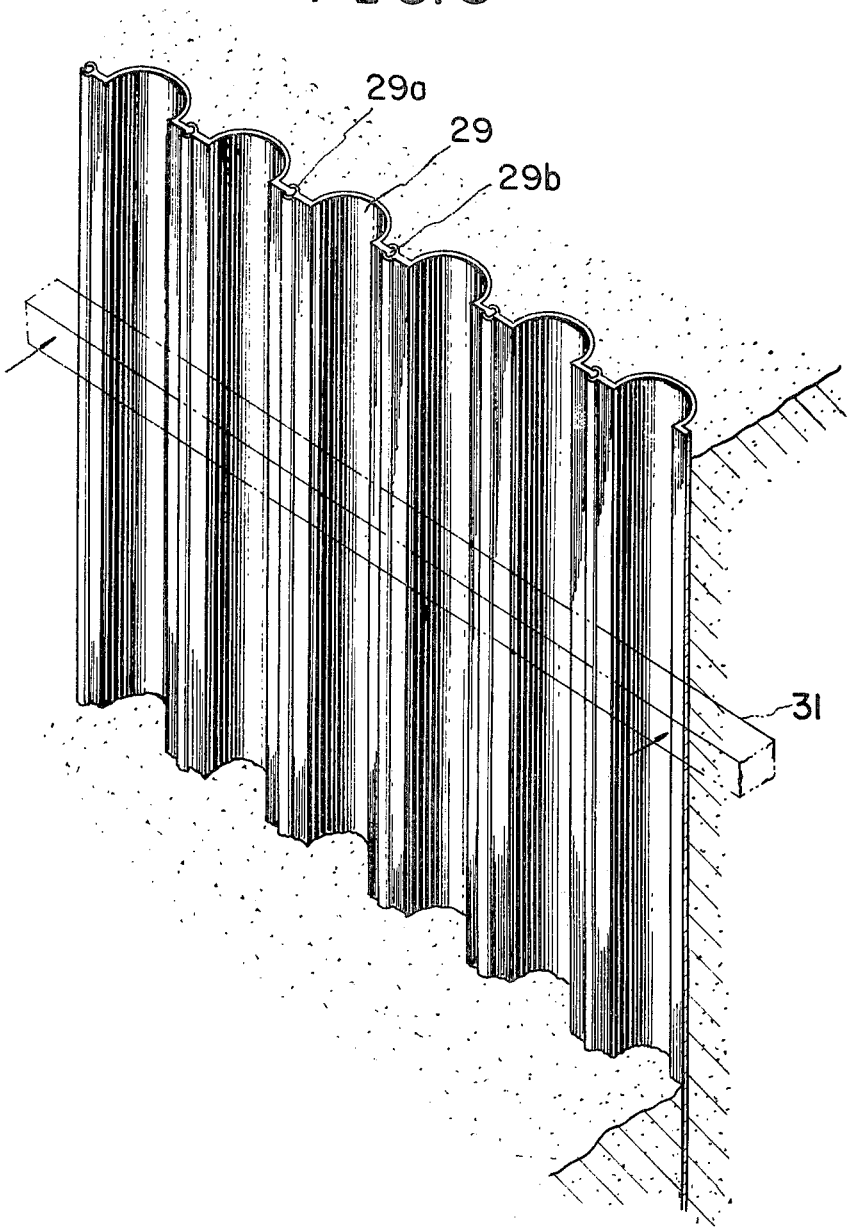
FIG. 3 is a perspective view of a wall constructed according to the present invention.

FIG. 3 is a partly sectional perspective view of a wall constituted by only sheet piles. As for this type of wall earth or concrete is placed at the bottoms of holes 30 to a certain height in the state shown in FIG. 2(C), and thereafter earth inside the curves of the sheet piles 29, i.e. on the side of the holes 30, is removed to a certain depth, and earth on the opposite side is supported.

Figures 5, 6, 7:
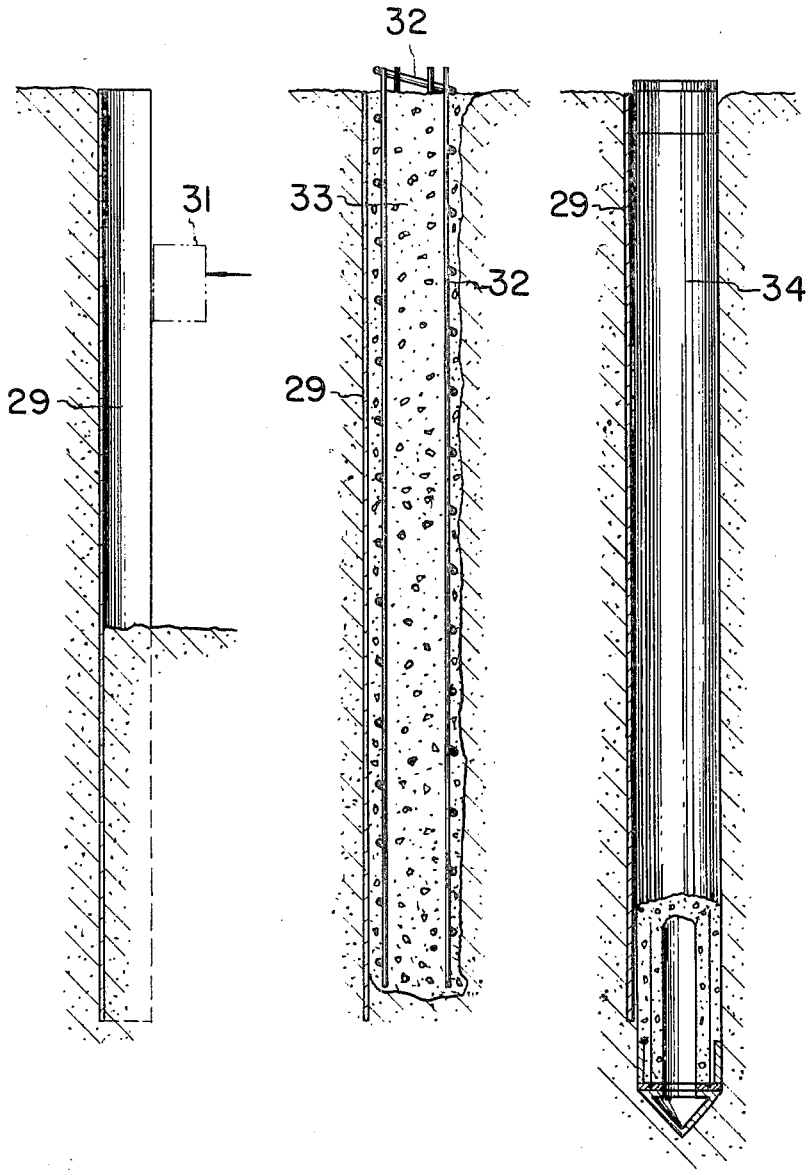
FIG. 5 is a sectional elevation view of a wall constituted by only sheet piles.
FIG. 6 is a sectional elevation view of a wall under construction in which concrete is placed at the rear part of sheet piles.
FIG. 7 is a sectional elevation view of a wall under construction in which concrete piles are sunk at the rear part of sheet piles.

FIG. 5 is a sectional elevation view of a completed wall constructed as abovementioned. As also shown in FIG. 3 it is possible that a horizontal connecting member 31 of column or plate shape is pushed or fastened on the wall and further tie rods are provided as required.

Figure 4:
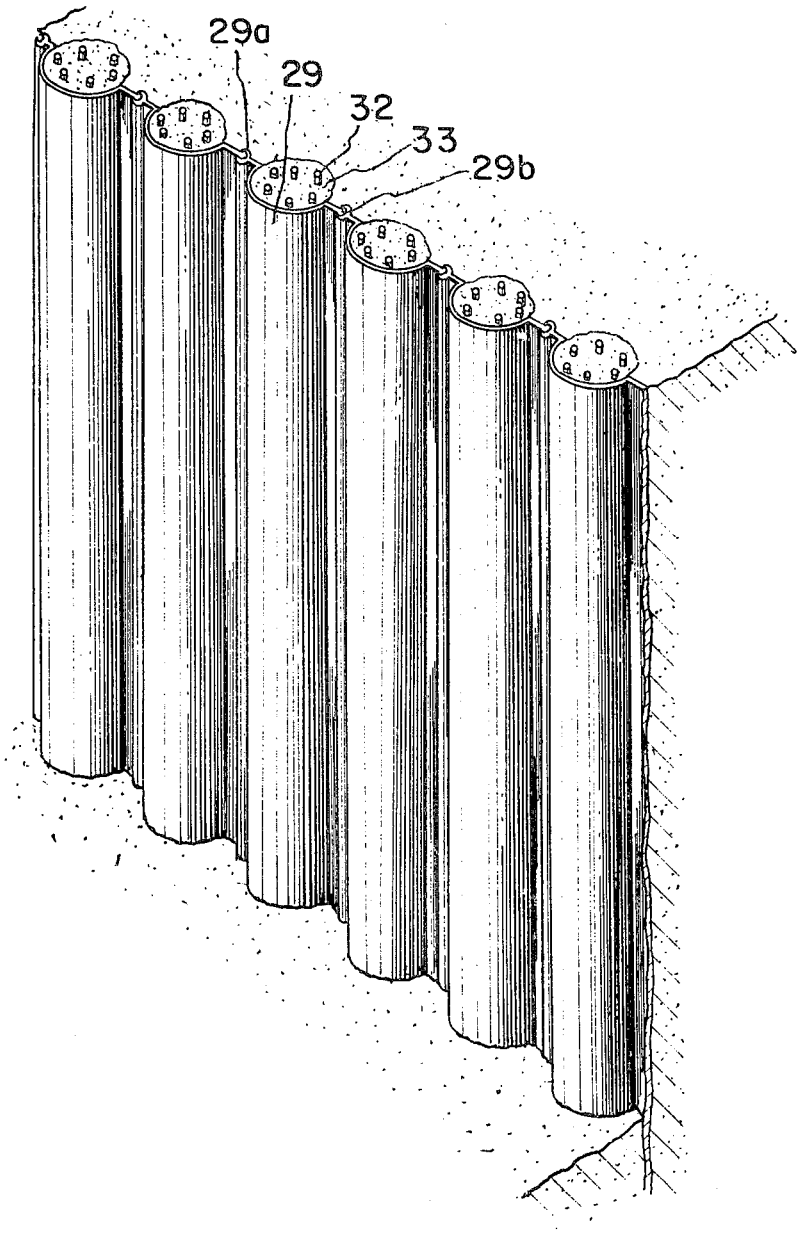
FIG. 4 is a perspective view of other wall constructed according to the present invention.

FIG. 4 is a partly sectional perspective view of a wall constructed according to other embodiment of the present invention. In the present embodiment reinforcements or wire cages 32 are inserted into holes 30 of a continuous wall constituted by sheet piles 29 and thereafter the holes 30 are charged with concrete 33.

FIG. 6 is a sectional elevation view of a state in which wire cages 32 and concrete 33 are placed into the holes 30 as abovementioned. In this state, earth outside the curves of sheet piles 29, i.e. on the opposite side of the holes 30, is removed to a certain depth, and the construction finishes in the state shown in FIG. 4. Since in this type of wall earth is supported by columns of concrete 33 which are made at a construction field as well as sheet piles 29, more strengthened wall can be obtained.

FIG. 7 is a sectional elevation view of a wall under construction in the third embodiment of the present invention. In the present embodiment concrete piles 34 are sunk into each hole 30 in the state shown in FIG. 2(C). The sinking depth of the said piles 34 can be made more deep or shallow than that of sheet piles 29 as required. The pile 34 is sunk into the hole 30 by hanging down or pushing from the upper side after the screw auger is taken out from the hole 30.

Similarly to the embodiments shown in FIGS. 3 and 4 earth outside the curves of sheet piles 29, i.e. on the opposite side of the piles 34, is removed remaining the forward ends of sheet piles 29 by a certain depth. In the present embodiment, since piles 34 directly support earth, very strong wall can be obtained as compared with the abovementioned two embodiments.

In the abovementioned three embodiments sheet piles having joints 29*a* and 29*b* of circular section are arranged in the same manner as shown in FIG. 8. Sheet piles 29' having joints 20'*a* and 29'*b* of plate shape which are shown in FIG. 9 can be also used in the said three embodiments.

Furthermore the aspect of each sheet pile 29 or 29' can be changed one after the other or at optional positions as shown in FIG. 10. In case the aspect is changed one after the other, holes 30 are bored on different sides of sheet piles one after the other. Therefore if a wall is constituted only by sheet piles, the lower parts or the whole parts of holes 30 have to be filled with earth or the like. If concrete is placed into holes 30 of one side, the bottoms of holes of another side are required to be filled with earth to a certain height. It also applys to the case in which concrete piles 34 are put into holes 30. However in that case concrete piles can be put into holes even on the side where earth is removed. On occasion it is preferable for the reinforcement of a wall.

The change of aspect of sheet piles 29 or 29' can be executed at optional positions. For example in case a wall is reinforced by concrete piles from the outside of the wall at regular intervals, it is very effective.

We claim:

1. A method of constructing a continuous wall for supporting earth, said wall including a plurality of similar interconnected generally semicircular casings, comprising the steps of:

aligning a first generally semicircular casing generally concentrically with a drilling device for producing a circular hole in earth, said hole having a radius substantially equalling the arc radius of said generally semicircular casing;

advancing said drilling device thereby producing a first hole in the earth;

pressing said semicircular casing into said hole substantially concurrently with said advancement of said drilling device;

withdrawing said drilling device from said hole after advancement through a desired distance;

displacing said drilling device from said first hole by a distance generally equalling the diameter of said first hole whereby a second hole approximately tangent to said first hole can be drilled, said distance being measured generally parallel to the base of the arc of said first generally semicircular casing inserted in said first hole;

aligning a second generally semicircular casing generally concentrically with said drilling device;

slidably interconnecting a longitudinal edge of said second generally semicircular casing to a longitudinal edge of said first generally semicircular casing;

advancing said drilling device to produce said second hole;

pressing said second generally semicircular casing, slidably interconnected to said first semicircular casing, into said second hole concurrently with said advancement of said drilling device; and withdrawing said drilling device from said second hole after advancement through a desired distance.

2. The method of claim 1 wherein said generally semicircular casings are vertically oriented and said pressing is accomplished by weight applied atop said casing aligned to said drilling device.

3. The method of claim 1 wherein said drilling device is a screw auger.

4. The method of claim 1 wherein the arcuate portion of said generally semicircular casings is a semicircle.

5. The method of claim 1 wherein the arcuate portion of said generally semicircular casings is one-half of a regular polygon.

6. The method of claim 1 wherein said generally semicircular casings have one longitudinal edge terminated in a C-section and the other longitudinal edge terminated in a circular section, and said circular section is nested within and slides within said C-section of the next adjacent casing whereby said interconnection of said casings is accomplished.

7. The method of claim 1 wherein said generally semicircular casings have one longitudinal edge radially protruding and the other longitudinal edge has a radial groove therein; and said radially protruded edge is nested within and slides within said radial groove of the next adjacent casing whereby said interconnection of said casings is accomplished.

8. The method of claim 1 wherein the convex surfaces of said adjacent generally semicircular casings are similarly oriented.

9. The method of claim 1 wherein the convex surfaces of said adjacent generally semicircular casings are oppositely oriented.

10. The method of claim 1 further comprising the step of pouring concrete into said hole after withdrawal of said drilling device.

11. The method of claim 10 wherein said concrete is reinforced.

* * * * *